United States Patent [19]

Mast et al.

[11] Patent Number: 4,914,764

[45] Date of Patent: Apr. 10, 1990

[54] BATH PIGMENTATION OF LEATHER

[75] Inventors: Jan H. Mast, Hünfelden; Lothar Schlösser, Frankfurt am Main; Rainer Winter, Oberursel, all of Fed. Rep. of Germany

[73] Assignee: Hoechst Aktiengesellschaft, Frankfurt am Main, Fed. Rep. of Germany

[21] Appl. No.: 379,574

[22] Filed: Jul. 12, 1989

[30] Foreign Application Priority Data

Jul. 14, 1988 [DE] Fed. Rep. of Germany ..... 3823826

[51] Int. Cl.[4] ..... D06P 3/32

[52] U.S. Cl. ..... 8/436; 8/404

[58] Field of Search ..... 8/436, 437, 404

[56] References Cited

U.S. PATENT DOCUMENTS 4,403,077 9/1983 Uhrig et al. ..... 525/502

*Primary Examiner*—Prince E. Willis

*Assistant Examiner*—John F. McNally

[57] ABSTRACT

Process for the bath pigmentation of leather, which comprises dyeing the leather with pigment dispersions which contain a compound of the formula (I)

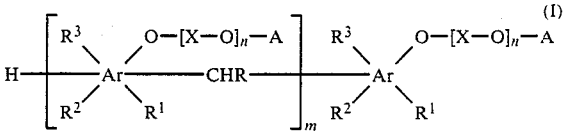

(I)

where

Ar is benzene or naphthalene,

X is $—CH_2—CH_2—$ and/or $—CH_2—CH(CH_3)—$, 0 to (m−1) of the radicals A are hydrogen, 1 to m of the radicals A are benzoyl and/or naphthoyl, 1 to m of the radicals A are $—CO—CH{=}CH—COOM$ and/or $—CO—CH_2—CH(SO_3M)—COOM$, where M is a cation, $R^1$, $R^2$ and $R^3$ are hydrogen or alkyl of 1 to 14 carbon atoms, R is hydrogen and/or alkyl of 1 to 9 carbon atoms, n is a number from 1 to 150 and m is a number from 2 to 12, The pigment having an average particle size of 50 to 500, preferably 80 to 300, nm. By using these dispersions, which contain the pigments in a very finely divided form, it is possible to obtain thorough penetration of the leather with improved light fastness.

7 Claims, No Drawings

BATH PIGMENTATION OF LEATHER

DESCRIPTION

The present invention relates to a pigment dyeing process which can be applied to wetblue leather, crusted leather and leather from all kinds of animals.

Pigment dyeings of leather have been known for a long time. The first such dyeings were obtained by rubbing insoluble colored pigment particles (marble dust, carbon black, clay) into the leather. To the present day pigment dyeings continue to be of interest; for instance, titanium dioxide is used for brightening a white tanning in retanning or after the leather has dried. Occasionally, too, carbon black is used for deepening the shade.

The disadvantage with the pigment dyeings customary these days is the lack of adhesion of the pigment to the leather. Inadequate fixation and poor wet and dry rub fastness values are the result. A pigment-treated leather has normally not been fully penetrated.

Similarly, the dyeing of leather with soluble dyes has disadvantages in some instances. Depending on the dye, poor light, perspiration or migration fastness properties are obtained. Problems involving insufficient wet and/or dry rub fastness are likewise known here.

These disadvantages can be avoided with the pigment dyeing process described hereinafter.

There has been a trend for some years to use pigments to improve the light fastness of all types of leather, particularly those which are given little or no dressing (apparel leather, furniture leather, full grain upper leather). Similarly, the appearance is said to be improved by hiding small grain defects with pigments. However, the pigments used today in the leather industry are, as described, notable for inadequate adhesion, unlevelness and in some instances for unattractiveness through pigment encrustation on the leather surface.

It has now been found that these disadvantages can be circumvented by the use of extremely finely divided pigments. Penetration of the leather is possible, and the light fastness values of the leather are better than those of leathers dyed with dyes. Wet and dry rub fastness is satisfactory, and the migration fastness is good (no migration), the perspiration fastness is excellent, minor grain defects in the leather can be hidden, the leathers are dyed level, and their hand does not change. The working methods correspond to the customary dyeing methods, so that no major changes are required in the factory to carryout this process.

The present invention accordingly provides a process for the bath pigmentation of leather, which comprises dyeing the leather with pigment dispersions which contain a compound of the formula (I)

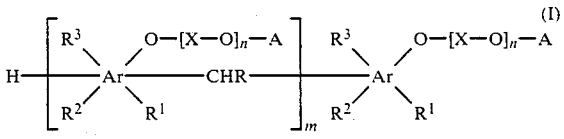

(I)

where

Ar is benzene or naphthalene,

X is $-CH_2-CH_2-$ and/or $-CH_2-CH(CH_3)-$, 0 to (m−1) of the radicals A are hydrogen, 1 to m of the radicals A are benzoyl and/or naphthoyl, 1 to m of the radicals A are $-CO-CH=CH=COOM$ and/or $-CO-CH_2-CH(SO_3M)-COOM$, where M is a cation, $R^1$, $R^2$ and $R^3$ are hydrogen or alkyl of 1 to 14 carbon atoms, R is hydrogen and/or alkyl of 1 to 9 carbon atoms, n is a number from 1 to 150 and m is a number from 2 to 12, the pigment having an average particle size of 50 to 500, preferably 80 to 300, nm.

The aforementioned compounds and the preparation of pigment dispersions by means of these compounds are described in DE-A-3,120,697. Preference is given to those compounds of the above formula where $R^1$ is hydrogen, $R^2$ and $R^3$ are hydrogen or alkyl of 1 to 12 carbon atoms, advantageously 1 to 9 carbon atoms, R is hydrogen and/or alkyl of 1 to 4 carbon atoms, advantageously hydrogen, n is a number from 2 to 20, advantageously 8 to 20, m is a number from 4 to 10, advantageously 4 to 8, M is hydrogen, an alkali metal, advantageously sodium, one equivalent of an alkaline earth metal and/or an ammonium group which can be substituted by lower alkyl and/or lower hydroxyalkyl, and an ammonium group obtained from ammonia or lower alkylamines by addition of up to 150, advantageously of 5 to 30, ethylene oxide and/or propylene oxide units.

These compounds are prepared by treating novolak alkoxylates of the formula I where A is hydrogen and Ar, X, $R^1$, $R^2$, $R^3$, R, n and m are as defined above with 1 to m moles of a benzoyl- and/or naphthoyl-introducing O-acylated compound and with 1 to m moles of maleic anhydride and with or without 1 to m moles of sulfite or bisulfite or 0.5 to 0.5 m moles of disulfite and neutralizing any free acid groups with a base which introduces the radical M.

Besides the abovementioned compounds of the formula I, the pigment dispersions may also also contain lecithin as a further dispersant.

These dispersants can be used in a conventional manner to prepare aqueous pigment dispersions by dispersing the pigments, such as azo pigments, laked azo pigments triphenylmethane pigments, thioindigo pigments, perylenetetracarboxylic acid pigments, dioxazine pigments, quinacridone pigments, phthalocycanine pigments or inorganic pigments, with these dispersants in the presence of ethylene glycol, water and with or without small amounts of other dispersants in a suitable dispersing apparatus, for example a stirred bore mill, bead mill or a double trough kneader. The ratio of dispersant to pigment powder can vary within wide limits and is in general 0.1 to 0.2 part by weight of dispersant per part of dry pigment powder. In addition to their use as dispersants, the abovementioned compounds of the formula (I) can also be used as coupling aids. The amount of lecithin if 0.05 to 0.25% by weight, based on the pigment powder. The dispersions of pigment power and compounds of the formula I were prepared in the presence of water and are obtained in the form of doughs which in this form can be used in the process according to the invention. However, these water-containing dispersions can also be dried. The powder thus obtained is likewise suitable for dyeing leather as part of the process according to the invention. The term dispersion thus encompasses here and hereinafter not only water-containing dispersions but also water-free powders.

As preparation for the process according to the invention, the leather is first wetted back in a conventional manner, for example with approximately 2% of concentrated ammonia solution and 0.1 to 2, preferably 0.2 to 0.5, % of wetting agent, based on the dry weight of the leather. Suitable wetting agents for this stage are for example polyethylene glycols having a molecular weight of 100 to 2,000, preferably 200 to 1,000, esters of the formula $R_1$—COO—$(CH_2)_n$—$SO_3Na$, where $R_1$ is $C_8$–$C_{25}$-alkyl, preferably $C_{12}$–$C_{18}$-alkyl, and n is a number from 1 to 12, preferably from 2 to 5, or ethoxylated fatty alcohols, fatty acids, fatty acid amides, secondary alkanesulfonate, phenol, naphthol and alkylphenols containing 1 to 100, preferably 3 to 20, oxyethylene units.

After wetting back, the leather is rinsed and introduced into a fresh ammoniacal liquor. The treatment then takes place which is designed to introduce substances into the leather which fix the subsequent pigment dyeing. This treatment will hereinafter be referred to as "prefixation".

Suitable for the prefixation are water-soluble polyurethanes and condensation products of formaldehyde with melamine (molar ratio 3:1 to 12:1, preferably 4:1 to 6:1), dicyandiamide (molar ratio 1:1 to 3:1), urea (molar ratio 1:1 to 3:1, preferably 1.5:1 to 2.8:1), phenol (molar ratio 0.5:1 to 2:1), naphthol (molar ratio 0.5:1 to 2:1) and aromatic sulfonic acids, preferably naphthalenesulfonic acid (molar ratio 3:1 to 12:1, preferably 5:1 to 8:1).

Similarly, it is possible to use these condensation products in their sulfonated form for the prefixation. The amount of such condensation products is about 0.2 to 4, preferably 1.5 to 2.5, %, based on the shaved weight of the leather, and about 0.3 to 5, preferably 1 to 3, %, based on the dry weight of the leather.

The prefixation is followed in the same liquor by the actual pigment dyeing. This step makes it necessary to use substances which ensure uniform dyeing of the pigments on the leather (leveling agents).

Suitable leveling agents are the wetting agents described above for the wetting back and in addition lecithin and condensation products of protein hydrolysates having a molecular weight of about 100 to 10,000, preferably 300 to 3,000, and $C_6$–$C_{30}$- fatty acids, preferably, $C_8$–$C_{18}$- fatty acids. These leveling agents are used in amounts of 0.1 to 3%, preferably 0.8 to 1.2%, based on the shaved weight of the leather, and 0.5 to 2, preferably 0.8 to 1.5, based on the dry weight of the leather.

In addition to these leveling agents the liquor contains the pigment, which had been treated with the dispersants described at the beginning to prepare a dispersion in which the pigment is present in an average particle size of 50 to 500, preferably 80 to 300, nm. The amount of pigment dispersion is 0.5 to 3, preferably 1 to 2, %, based not only on the shaved weight but also the dry weight of the leather. To avoid an unlevel pigment dyeing due to excessively fast dyeing of the pigments, short liquor ratios (about 30 to 300%) and temperatures of 20 to 40° C. are employed.

When choosing the pigments, it is advisable to use only those pigments which have a good fat resistance. In particular in trichromatic pigmentation, there is a danger of the individual constituents going on at different rates.

If the leather is to be glazed, care must also be taken to ensure that the pigments used all have adequate temperature resistance. This avoids color changes on glazing. Even if bath-pigmented leathers are processed undressed in hot presses at temperatures above 120° C., the temperature resistance of the pigments should be checked. This also applies to any vulcanization in shoe manufacture.

The leather thus dyes can subsequently be fatliquored in a conventional manner. After the fatliquoring or else directly after the pigment dyeing, the pigments are subjected to a fixation and postfixation. Both fixation and postfixation are effected by treating the leather in a conventional manner with an organic acid, for example formic acid or acetic acid, or glycol diformate. The amount of these acids is approximately 2 to 5, preferably 2 to 4, %, based on the shaved weight of the leather or 5 to 8%, preferably 4 to 6%, based on the dry weight of the leather.

It is also possible to subject the leather additionally to a postpigmentation step. In this postpigmentation step, the pigments only are to be deposited at the surface in order to obtain coverage of the grain defects in the leather and thus to improve the leather quality. This postpigmentation is effected either with customary coarsely divided pigments are else with the finely divided pigments used beforehand for the first pigment dyeing.

If the postpigmentation step is carried out with finely divided pigments, it is necessary to precede their use with very specific pretreatment of the leather (priming). This pretreatment can be carried out with polyurethane or polymers which can be polymerized from the following monomers in various mixing ratios: acrylic acid and its methyl, ethyl, propyl, butyl, hexyl, methylhexyl or octadecyl esters, methacrylic acid and its methyl, ethyl, propyl, butyl, hexyl, methylhexyl or octadecyl esters; acrylamide, acrylonitrile, vinyl acetate, ethylene, styrene, maleic anhydride, maleic acid, maleic monoesters and diesters, N-vinyl-N-methylacetamide, acrylamidomethylenepropylsulfonate, vinylformamide, glycidyl methacrylate, diallyldimethylammonium chloride.

The molecular weights of these polymers are within the range from 100 to 10,000, preferably 150 to 3,000. Preference is given to polymers of vinyl acetate (50–80%) and ethylene (20–50%) or styrene (30–60%) and maleic anhydride (40–70%) or hydroxystyrene. The amount of these assistants is 1 to 4, preferably 1.5 to 2.5, %, based on the shaved weight of the leather, or 1 to 6, preferably 2 to 3, %, based on the dry weight of the leather. The actual postpigmentation is effected in the same manner as the first pigmentation described above, with 0.5 to 4, preferably 1.5 to 3, % of pigment, based on the shaved weight of the leather, or with 1 to 4, preferably 1.5 to 3, %, based on the dry weight of the leather. For this postpigmentation operation, too, the same leveling agents are used in the same amount as beforehand in the first pigmentation. The postpigmentation operation is followed by fixation and postfixation, as described above.

The above-described procedure relates to crusted leather. In the bath pigmentation of shaved leathers, wetting back is dispensed with. Instead, the leather is rinsed, neutralized and rinsed again prior to the bath pigmentation. After the bath pigmentation but before any fatliquoring, the leather is then retanned. With all the processes it is also possible to dye the leather additionally with soluble dyes in a conventional manner. This can be done prior to the bath pigmentation, after the bath pigmentation or after the fixation stage.

EXAMPLE 1

Bath pigmentation of furniture leather

Material: crusteds

| | |
|---|---|
| Wetting back | 2 h |
| 1.000% of water at 50° C.<br>2% of ammonia at 25%<br>0.5% of nonylphenol ethoxylate (15 units of ethylene oxide) | |
| Rinsing | 10 min. |
| Water at 20° C. | |
| Prefixing | 10 min. |
| 500% of water at 20° C.<br>2% of sulfonated melamine-formaldehyde condensation product (molar ratio 1:4) | |
| Pigmenting + | 40 min. |
| 1% of pigment mixture I<br>4% of ammonia at 25%<br>0.15% of nonylphenol ethoxylate (15 units of ethylene oxide)<br>2% of condensation product of protein hydrolysate and fatty acid | |
| Fatliquoring + | 40 min. |
| 5% of leather fatliquoring agent | |
| Souring off + | 20 min. |
| 500% of water at 60° C. (bath temperature 40° C.)<br>5% of formic acid at 85% | |
| Postfixing + | 20 min. |
| 1% of formaldehyde-dicyandiamide condensation product (molar ratio 3:1) | |

The leathers are finalized in a conventional manner.

EXAMPLE 2

Bath pigmentation of furniture leather

Material: crusteds

| | |
|---|---|
| Wetting back | 2 h |
| 1,000% of water at 50° C.<br>2% of ammonia at 25%<br>0.5% of octadecyl alcohol + 10 moles of ethylene oxide | |
| Dropping, rinsing | 10 min. |
| water 50% | |
| Dyeing | 40 min. |
| 500% of water at 50° C.<br>2% of Acid Brown 270 (water-soluble dye)<br>0.3% of polyethylene glycol (molecular weight 500) | |
| Souring off + | 20 min. |
| 3% of formic acid at 85% | |
| Rinsing | 10 min. |
| Water at 20° C. | |
| Prefixing | 10 min. |
| 500% of water at 20° C.<br>4% of ammonia at 25%<br>2% of sulfonated melamine-formaldehyde condensation product (molar ratio 1:4)<br>3% of Cassel Brown | |
| Bath pigmenting 1 + | 40 min. |
| 2% of pigment mixture II<br>0.15% of nonylphenol ethoxylate (15 units of ethylene oxide)<br>2% of protein hydrolysate/stearic acid condensation product (molecular weight about 2,000) | |
| Souring off + | 20 min. |
| 4% of formic acid at 85% | |
| Rinsing | 10 min. |

-continued

| | |
|---|---|
| water at 20° C. | |
| Bath pigmenting 2 | 40 min. |
| 500% of water at 20° C.<br>1% of pigment mixture III<br>2% of pigment paste IV (more coarsely divided)<br>1% of octylphenol + 15 moles of ethylene oxide | |
| Fatliquoring + | 40 min. |
| 5% of leather fatliquoring agent | |
| Souring off + | 20 min. |
| 500% of water at 60° C. (bath temperature 40° C.)<br>3% of formic acid at 85% | |
| Redyeing + | 30 min. |
| 0.8% of Acid Brown 270 (water-soluble dye) | |
| Souring off + | 20 min. |
| 1% of formic acid at 85% | |
| Postfixing + | 20 min. |
| 0.7% of formaldehyde-dicyandiamide condensation product (molar ratio 3:1) | |

The leathers are finalized in a conventional manner.

EXAMPLE 3

Bath pigmentation of upper leather

Material: shaved wetblue

| | |
|---|---|
| Rinsing | 10 min. |
| water at 35° C. | |
| Neutralizing | 40 min. |
| 150% of water at 35° C.<br>1% of Na acetate<br>0.5% of Na bicarbonate | |
| Rinsing | 10 min. |
| water at 20° C. | |
| Prefixing | 10 min. |
| 100% of water at 20° C.<br>2% of ammonia at 25%<br>2% of sulfonated melamine-formaldehyde condensation product (molar ratio 1:3) | |
| Bath pigmenting + | 40 min. |
| 1% of pigment mixture V<br>2% of formaldehyde-urea condensa-sation product (molar ratio 1:1) | |
| Retanning + | 40 min. |
| 4% of vegetable tanning agent | |
| Fatliquoring + | 40 min. |
| 8% of leather fatliquoring agent | |
| Souring off + | 20 min. |
| 100% of water at 60° C. (bath temperature 40° C.)<br>4% of formic acid at 85% | |
| Postfixing + | 10 min. |
| 1% of formaldehyde-melamine condensation product (molar ratio 2.5:1) | |

The leathers are finalized in a conventional manner.

EXAMPLE 4

Bath pigmentation of upper leather Material: shaved wetblue

| | |
|---|---|
| Rinsing | 10 min. |
| water at 35° C. | |
| Neutralizing | 40 min. |

-continued

| | |
|---|---|
| 150% of water at 35° C.<br>1% of Na acetate<br>0.5% of Na bicarbonate | |
| Rinsing | 10 min. |
| water at 50° C. | |
| Predyeing | 20 min. |
| 100% of water at 50° C.<br>1% of Acid Brown 408 (water-soluble dye) | |
| Souring off | 20 min. |
| 1% of formic acid at 85% | |
| Rinsing | 10 min. |
| water at 20° C. | |
| Prefixing | 10 min. |
| 100% of water at 20° C.<br>4% of ammonia at 25%<br>2% of formaldehyde-melamine condensation product (molar ratio 2.5:1) | |
| Bath pigmenting 1 | 40 min. |
| 1% of pigment mixture VI<br>0.2% of nonylphenol ethoxylate (20 units of ethylene oxide)<br>2% of sulfonated octyl stearate | |
| Retanning + | 40 min. |
| 4% of vegetable/synthetic tanning agent | |
| Fatliquoring + | 40 min. |
| 8% of leather fatliquoring agent | |
| Souring off + | 20 min. |
| 4% of formic acid at 85% | |
| Rinsing | 10 min. |
| water at 20° C. | |
| Priming | 20 min. |
| 100% of water at 20° C.<br>2% of copolymer of 70% vinyl acetate and 30% of ethylene | |
| Bath pigmenting 2 + | 40 min. |
| 1% of pigment mixture VI<br>1.5% of pigment paste VII (more coarsely divided)<br>0.2% of ethoxylated octadecyl alcohol (15 units of ethylene oxide)<br>2% of protein hydrolysate/stearic acid condensation product (molecular weight about 2,000) | |
| Souring off + | 20 min. |
| 4% of formic acid at 85% | |
| Postfixing + | 10 min. |
| 0.75% of formaldehyde/melamine condensation product (molar ratio 2.5:1) | |

The leathers are finalized in a conventional manner.

EXAMPLE 5

Bath pigmentation of wild crocodile leather Material: crusted, strongly synthetic/vegetable -retanned wild crocodile leather intended for a glazing finish.

| | |
|---|---|
| Wetting back | 2 h |
| 1,500% of water at 40° C.<br>2% of ammonia at 25%<br>0.2% of ethoxylated octadecyl alcohol (10 units of ethylene oxide)<br>0.2% of ethoxylated phenol (12 units of ethylene oxide) | |
| Rinsing | 10 min. |
| water at 20° C. | |

-continued

| | |
|---|---|
| Prefixing | 10 min. |
| 500% of water at 20° C.<br>2% of ammonia at 25%<br>2% of sulfonated melamine-formaldehyde condensation product (molar ratio 1:3) | |
| Bath pigmenting + | 40 min. |
| 1% of pigment VIII<br>2% of sulfonated fatty alcohol ester of fatty acid | |
| Fatliquoring + | 40 min. |
| 8% of leather fatliquoring agent | |
| Souring off + | 20 min. |
| 500% of water at 60° C. (bath temperature 40° C.)<br>5% of formic acid at 85% | |
| Postfixing + | 10 min. |
| 1% of formaldehyde-urea condensation product (molar ratio 2.5:1) | |

The leathers are finalized in a conventional manner.

EXAMPLE 6

Bath pigmenting of a apparel leather

Material: crusteds

| | |
|---|---|
| Wetting back | 10 min. |
| 1,000% of water at 50° C.<br>2% of ammonia at 25%<br>0.5% of ethoxylated nonylphenol (23 units of ethylene oxide)<br>0.5% of ethoxylated fatty alcohol | |
| Rinsing | 10 min. |
| water at 40° C. | |
| Bath pigmenting | 90 min. |
| 500% of water at 40° C.<br>2% of pigment mixture II powder<br>0.5% of lecithin | |
| Fixing | 30 min. |
| 3% of polyurethane dispersion 40% (Plastoderm E 1513) | |
| Souring off + | |
| 3% of glycol diformate + | 30 min. |
| 4% of formic acid at 85% | 60 min. |

brief cold rinse, finalizing in a conventional manner.

In Examples 1 to 6, use is made of the following pigments or pigment mixtures:

I

47% of Pigment Red 112
50% of Pigment Yellow 83
3% of Pigment Blue 15:3

II

40% of Pigment Red 184
50% of Pigment Yellow 83
10% of Pigment Black 7

III

40% of Pigment Red 184
50% of Pigment Yellow 83
10% of Pigment Black 7

IV

100% of Pigment Red 101

V

40% of Pigment Red 184
50% of Pigment Yellow 83
5% of Pigment Blue 15:3
5% of Pigment Black 7

VI

47% of Pigment Red 112
50% of Pigment Yellow 83
3% of Pigment Black 7

VII 66.7% of Pigment Red 101
20 % of Pigment Yellow 42
13.3% of Pigment Black 11

VIII

100% of Pigment Brown 1

The pigments or pigment mixtures I, II, III, V, VI and VIII contain the pigments in an extremely finely divided form in accordance with the present invention; they have been treated with the compound described in Example 3.5.1 of DE-A-3,120,697. The pigments and pigment mixtures IV and VII contain the pigments in the customary, more coarsely divided form.

We claim:

1. A process for the bath pigmentation of leather, which comprises dyeing the leather with pigment dispersions which contain a compound of the formula (I)

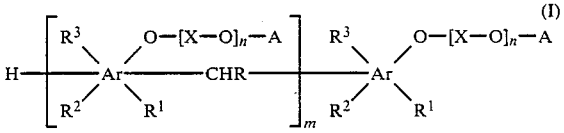

(I)

where

Ar is benzene or naphthalene,

X is $—CH_2—CH_2—$and/or $—CH_2—CH(CH_3)—$, 0 to (m—1) of the radicals A are hydrogen, 1 to m of the radicals A are benzoyl and/or naphthoyl, 1 to m of the radicals A are —CO—CH=CH—COOM and/or $—CO—CH_2—CH(SO_3M)—$COOM, where M is a cation, $R^1$, $R^2$ and $R^3$ are hydrogen or alkyl of 1 to 14 carbon atoms, R is hydrogen and/or alkyl of 1 to 9 carbon atoms, n is a number from 1 to 150 and m is a number from 2 to 12, the pigment having an average particle size of 50 to 500, preferably 80 to 300, nm.

2. The process as claimed in claim 1, wherein the leather is dyed with pigment dispersions which contain a compound of the formula (I) where $R^1$ is hydrogen, $R^2$ and $R^3$ are hydrogen or alkyl of 1 to 12 carbon atoms, R is hydrogen and/or alkyl of 1 to 4 carbon atoms, n is a number from 2 to 20, m is a number from 4 to 10, M is hydrogen, an alkali metal, one equivalent of an alkaline earth metal and/or an ammonium group which can be substituted by lower alkyl and/or lower hydroxyalkyl, and an ammonium group obtained from ammonia or lower alkylamines by addition of up to 150 ethylene oxide and/or propylene oxide units.

3. The process as claimed in claim 1, wherein the leather is dyed with pigment dispersions which contain a compound of the formula (I) where R is hydrogen, M is hydrogen, sodium and/or an ammonium group which can be substituted by lower alkyl and/or hydroxyalkyl and an ammonium group obtained from ammonia or lower alkylamines by addition of 5 to 30 ethylene oxide and/or propylene oxide units.

4. The process as claimed in claim 1, wherein the leather is dyed with pigment dispersions which contain a compound of the formula (I) where Ar is benzene, $R^2$ and $R^3$ are hydrogen or alkyl of 1 to 9 carbon atoms, n is a number from 8 to 20 and m is a number from 4 to 8.

5. The process as claimed in claim 1, wherein the leather is dyes with pigment dispersions which contain a compound of the formula (I) where Ar is naphthalene, $R^2$ and $R^3$ are hydrogen or alkyl of 1 to 9 carbon atoms, n is a number from 8 to 20 and m is a number from 4 to 8.

6. The process as claimed in claim 1, wherein the leather is dyed with pigment dispersions which contain the pigment in an average particle size of 50 to 500 nm.

7. The process as claimed in claim 1, wherein the leather is dyed with 0.5 to 2% by weight of the pigment preparation, based on the weight of the leather.

* * * * *